US006672636B2

(12) United States Patent
Kelly

(10) Patent No.: US 6,672,636 B2
(45) Date of Patent: Jan. 6, 2004

(54) SMOKE DETECTOR CHANGING DEVICE

(76) Inventor: Robert Kelly, 1140 Cabrillo Ave., Burlingame, CA (US) 94010

( * ) Notice: Subject to any disclaimer, the term of this patent is extended or adjusted under 35 U.S.C. 154(b) by 0 days.

(21) Appl. No.: 10/098,734

(22) Filed: Mar. 14, 2002

(65) Prior Publication Data

US 2002/0170142 A1 Nov. 21, 2002

Related U.S. Application Data

(60) Provisional application No. 60/275,896, filed on Mar. 14, 2001.

(51) Int. Cl.[7] ..... A47F 13/06
(52) U.S. Cl. ..... 294/19.1; 294/24
(58) Field of Search ..... 294/19.1, 24; 81/53.1, 81/53.11, 53.12; 250/381

(56) References Cited

U.S. PATENT DOCUMENTS 3,748,672 A * 7/1973 Patrick et al. ..... 441/131
3,900,795 A 8/1975 Larsen et al.
4,074,341 A * 2/1978 Niederost et al. ..... 361/600
4,350,338 A * 9/1982 May ..... 473/423
5,563,766 A 10/1996 Long et al.
5,596,314 A 1/1997 Goldstein
5,617,079 A 4/1997 Harrison
5,649,255 A * 7/1997 Schieltz ..... 396/427
5,765,453 A * 6/1998 Mims ..... 81/53.11
2002/0066845 A1 * 6/2002 Pitlor
2003/0029279 A1 * 2/2003 Wantz

* cited by examiner

*Primary Examiner*—Eileen D. Lillis
*Assistant Examiner*—Michael S. Lowe
(74) *Attorney, Agent, or Firm*—Dorsey & Whitney LLP

(57) ABSTRACT

The invention relates to a novel device for easy maintenance of smoke detectors, comprising a three dimensional "receptacle" that attaches to a pole and fits around a smoke detector housing to easily remove it from its mounting plate.

22 Claims, 12 Drawing Sheets

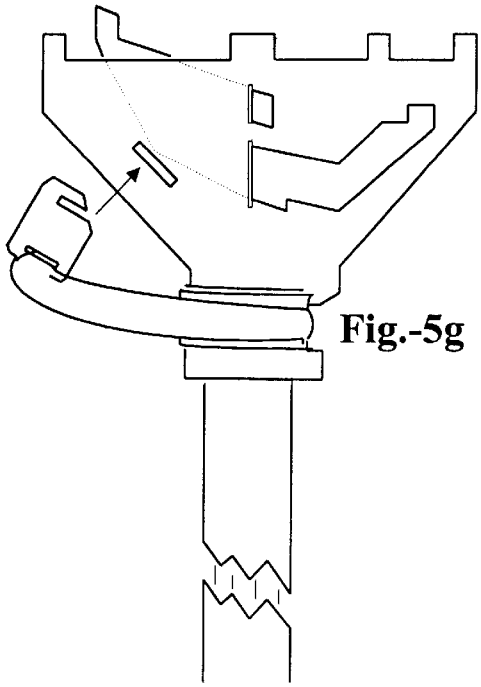
Fig.-5g
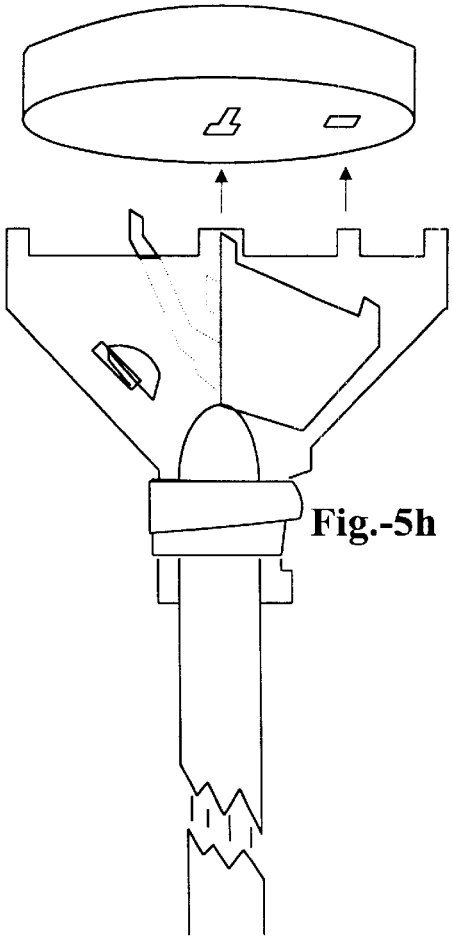
Fig.-5h
Fig.-5
| | |
|---|---|
| Fig.-5a | Fig.-5b |
| Fig.-5c | Fig.-5d |
| Fig.-5e | Fig.-5f |
| Fig.-5g | Fig.-5h |

SMOKE DETECTOR CHANGING DEVICE

This application is a continuing application of U.S. Ser. No. 60/275,896, filed Mar. 14, 2001.

FIELD OF THE INVENTION

The invention relates to a novel device for easy maintenance of smoke detectors, comprising a three dimensional receptacle or "cage" that attaches to a pole and fits around a smoke detector housing to easily remove it from its mounting plate.

BACKGROUND OF THE INVENTION

Smoke detectors detect the presence of smoke particles as an early indication of fire. Smoke detectors are used in closed structures such as houses, factories, offices, shops, ships, aircraft, and the like, with virtually every building being required by law to have some sort of early warning fire detection system. In general, smoke detectors are based on the principle of detecting smoke particles in the air. Thus, smoke detectors may include a chamber that admits a test atmosphere while blocking ambient light. A light receiver within the chamber receives a level of light from an emitter within the chamber, which light level is indicative of the amount of smoke contained in the test atmosphere. Different types of fires (depending on the materials being burned and the rate of burning) result in different sized smoke particles, which then are detected in a variety of ways, the most common of which is the detection of the blockage of a test light, usually solid-state optical receivers such as photodiodes.

While there are a wide variety of different mechanisms for the detection of smoke, from a consumer's point of view there are two types of smoke detectors. The first and most common, is the battery operated smoke detector. These are self contained, and most often utilize a mounting bracket of some sort which is attached to a ceiling or wall. The unit attaches in any number of ways to the mounting bracket. A light of some sort indicates the viability of the batteries, and when the batteries get low, or when other problems occur, the unit generally emits a loud and highly annoying noise, to signal that the batteries must be changed or the unit cleaned, etc. The consumer then generally mounts a ladder, the unit is then removed from the bracket manually, the batteries changed, and the unit remounted.

The second type of unit is one that is AC powered with a battery backup. These are more common in businesses such as hotels, as they allow the primary power source to be hard wired and the batteries are used only as a backup, thus significantly extending the battery life and allowing fewer maintenance trips.

All smoke detectors are generally mounted as high as possible within the room or area, due to the fact that heat and smoke rise, and thus the higher up they are mounted the earlier a fire may be detected. This fact, however, poses the problem the present invention addresses: how to easily service the smoke detector unit when it is mounted as high as possible. Currently, the only way to change the batteries in a smoke detector is to remove the unit manually, which requires the use of a ladder to access the unit.

Accordingly, it is an object of the present invention to provide a device and a method for easily servicing a smoke detector unit without the use of a ladder.

SUMMARY OF THE INVENTION

In accordance with the objects outlined above, the present invention provides smoke detector changing devices comprising a first base piece comprising an assembly slot and a second crosspiece, comprising an assembly tab for insertion into the assembly slot. Either the base piece or the crosspiece or the combination of the base piece and the crosspiece forms an asymmetrical insertion tab configured to fit into an asymmetrical slot in a smoke detector housing. The devices further comprise an attachment component attached to either the base piece or the crosspiece for the attachment of the device to a pole.

In an additional aspect, the present invention provides smoke detector changing devices comprising an engagement component comprising a receptacle configured to receive a smoke detector housing, the device comprising holder tabs to engage the housing and an attachment component for the attachment of the device to a pole.

In a further aspect, the present invention provides a smoke detector changing device comprising a base piece comprising an assembly slot, a crosspiece comprising an assembly tab for insertion into the assembly slot and an exterior mounting adapter bracket for attachment to a smoke detector. The bracket comprises an asymmetrical slot and adhesive mounts. Again, either the base piece or the crosspiece or the combination of the base piece or the crosspiece forms an asymmetrical insertion tab configured to fit into the asymmetrical slot and an attachment component attached to either the base piece or the crosspiece for the attachment of the device to a pole.

The devices all may be provided as kits with smoke detector units.

BRIEF DESCRIPTION OF THE DRAWINGS

FIGS. 5A–H depicts the instructions for assembly.

DETAILED DESCRIPTION OF THE INVENTION

Figure 1:
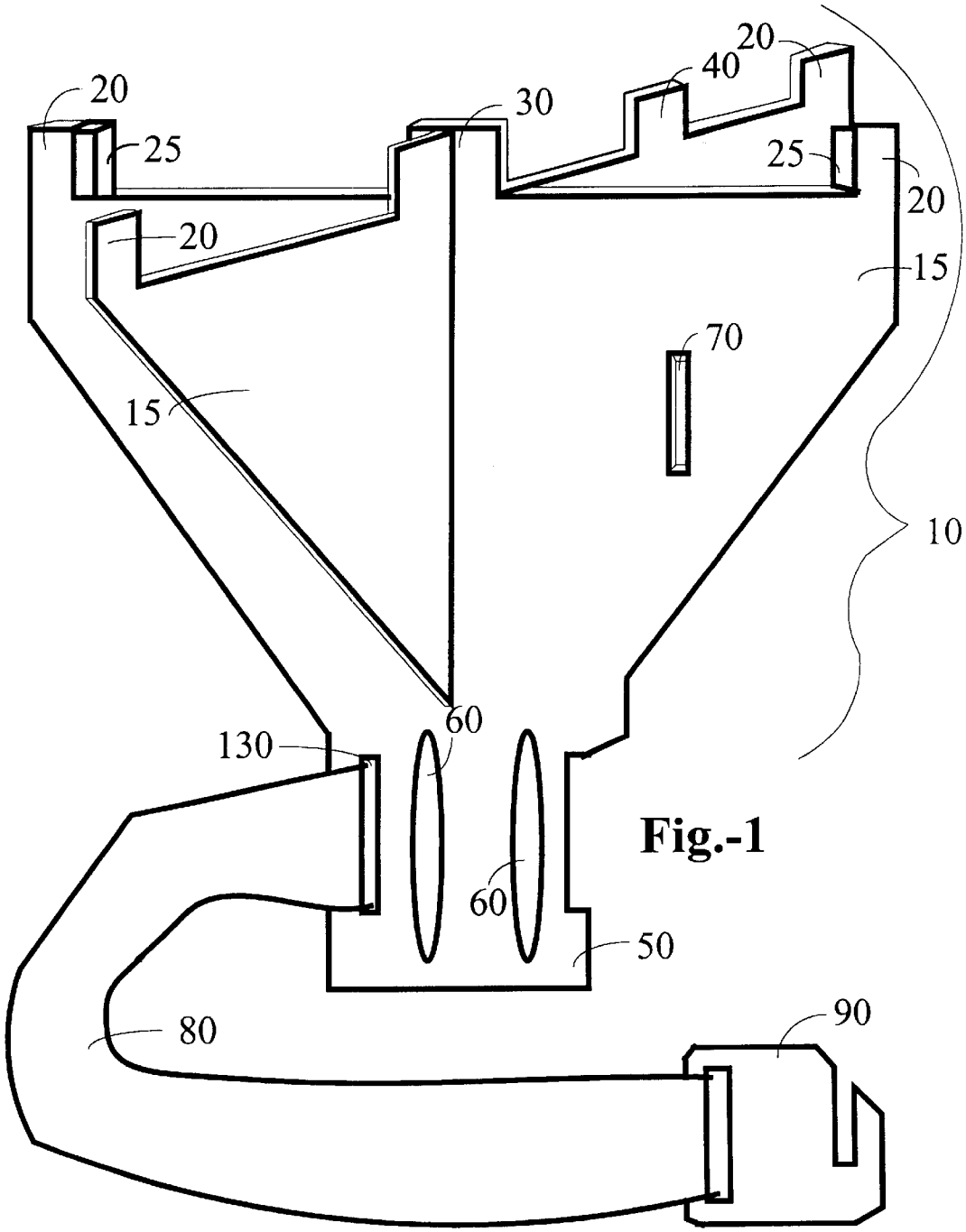
FIG. 1 depicts the "one component" device that is made of a single three dimensional structure.

The present invention provides devices and smoke detectors configured to allow users to remove a smoke detector (either a self-contained, completely battery operated unit, or a hard wired unit with battery backup) from its mounting bracket. The occasional removal of smoke detectors is necessary for normal maintenance (e.g. battery change) or problems with the unit (e.g. malfunction due to dust, spiders, etc.).

The device satisfies the needs of smoke detector owners who do not have access to ladders, stools, stepstools, etc. It also addresses the problem of those who are unable to use ladders to reach their smoke detector; for example, senior citizens at risk for falls, handicapped or wheelchair bound individuals, or those who suffer from medical ailments (e.g. vertigo, acrophobia). In addition, the device satisfies the needs of those in commercial applications where ladders may not be readily available, such as in a commercial business where a maintenance person is not available and a malfunctioning alarm is disruptive to normal commerce. Furthermore, the device finds use for individuals who service multiple devices, such as in apartment houses or hotels.

In general, the device comprises either a preformed or assembled three dimensional receptacle (or "cage") that is easily attached to the end of a pole, such as a broom, mop, can rake, etc., that contains tabs configured to firmly grasp the smoke detector housing (either through the use of tabs that insert into a preslotted housing, by gripping the edges of the smoke detector or by gripping a piece that has been attached by the consumer to the housing). Standing on the ground, an individual fits the receptacle around the smoke detector housing, rotates the device, and removes the detector from its mounting bracket. The batteries are changed, etc., and the housing replaced in the receptacle, which is then used to reattach the housing to its mounting bracket. As will be appreciated by those in the art, while most smoke detector units are round (generally 4.75 or 4 inches in diameter) the device can be configured to be used with any number of different shaped smoke detector units (square, rectangular, etc.).

In general, there are two categories of devices provided. The first category is directed to changing smoke detector units that are completely battery operated. Within this category, there are two main embodiments. The first embodiment provides a two part system: the changer (which generally comprises a plurality of components, as outlined herein), and the smoke detector, that has been configured to optimally receive the changer in several ways, as outlined below. In a second embodiment, in the case where the smoke detector is not especially configured to receive the changer of the invention, the invention comprises three parts: the changer (again, made of a variety of components), the detector, and an adapter component. The adapter component can be fixed to an existing smoke detector by any variety of means, as outlined below, and then used with the changer of the invention.

In an alternate preferred embodiment, the device is especially configured to be used with hard wired or AC units, that comprise both electronic components and battery backup. In this embodiment, the mounting bracket of the smoke detector comprises a plurality of interconnects or leads, that allow electronic communication between the electric wires in the wall or ceiling, through the mounting bracket to the smoke detector unit. In addition, as is more fully outlined below, an optional locking device, or anti-tamper tab, is used, which prevents the removal of the unit to expose live wires without the device.

Accordingly, the present invention provides smoke detector changing devices comprising a smoke detector changing device that will assemble into a three-dimensional "receptacle" suitable for attachment to a pole and able to sufficiently grip a smoke detector housing unit to allow it to be detached from its mounting bracket.

In a preferred embodiment, there are two components that form the receptacle, a base piece and a crosspiece. As noted herein and in the figures, these two components can either be made as one piece, as is depicted in FIG. 1, or as shown in the Figures.

Figure 2:
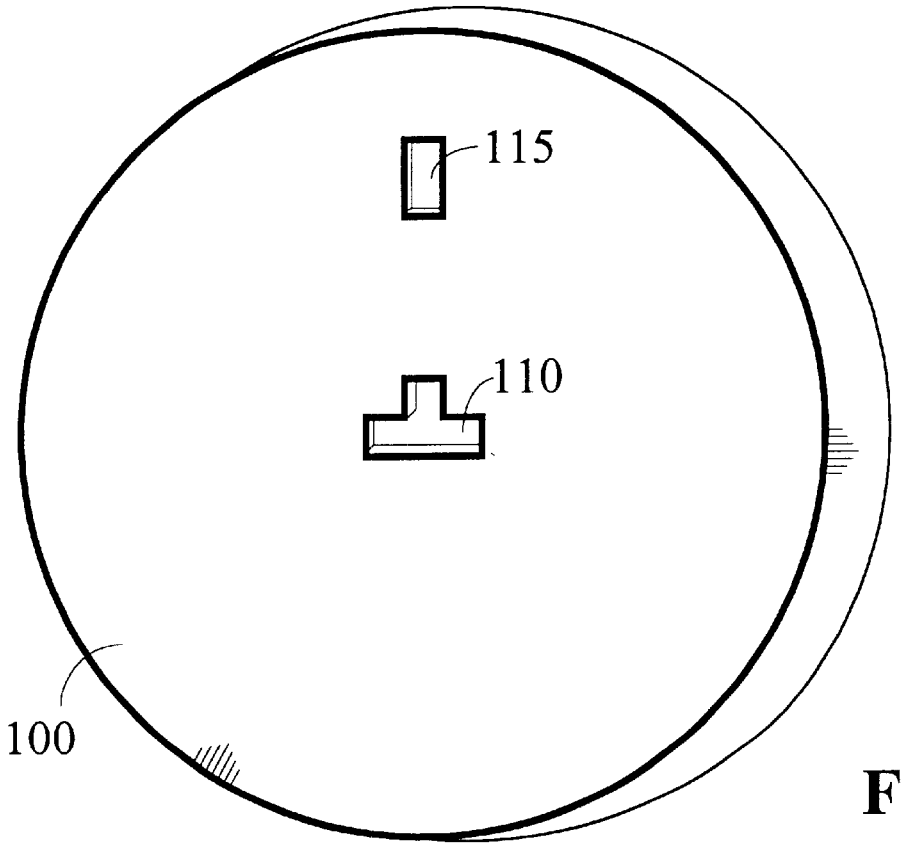
FIG. 2 depicts a smoke detector housing unit configured to receive a preferred device of the invention.
Figure 3:
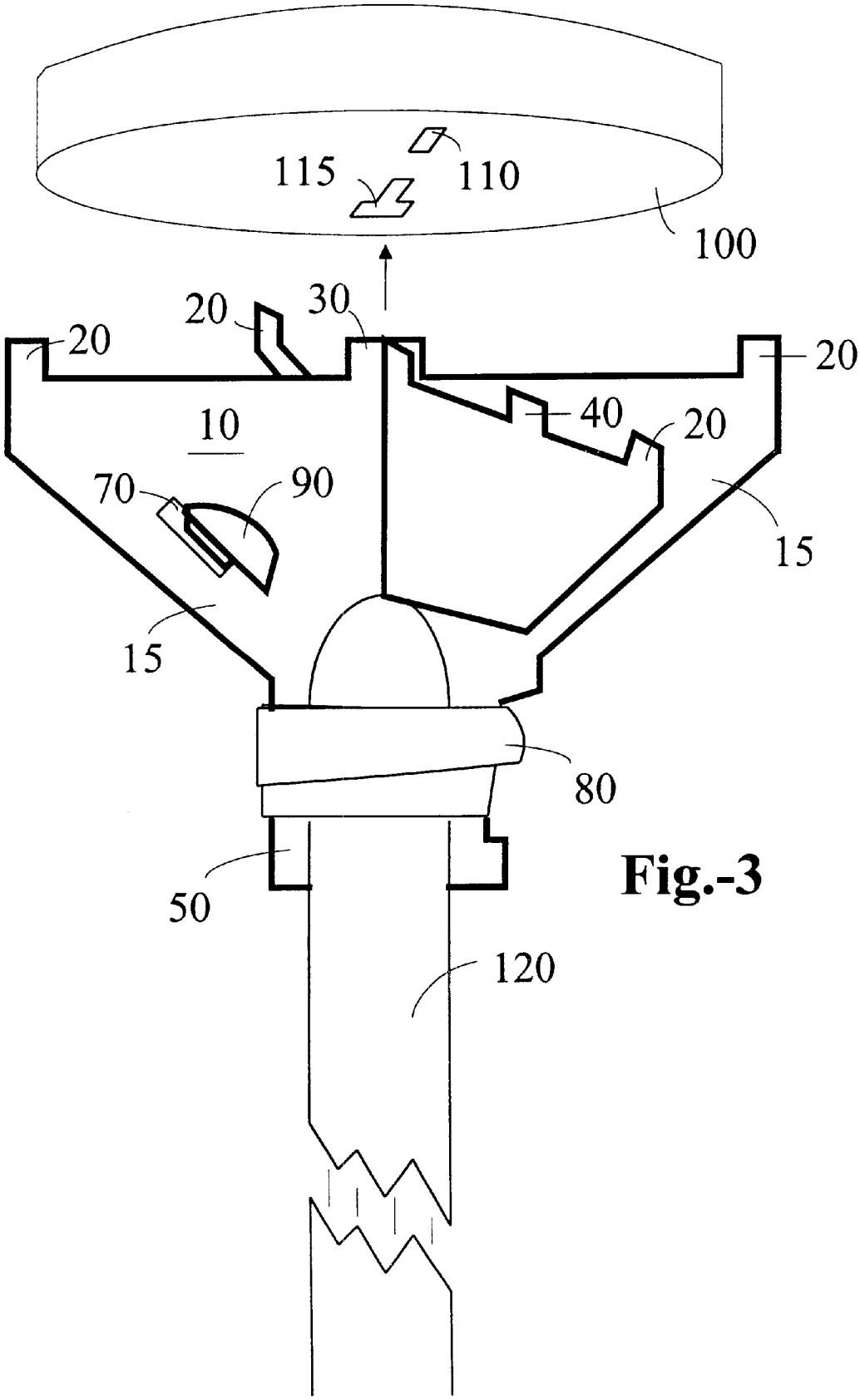
FIG. 3 depicts the insertion of a device of the invention into a smoke detector unit so configured.

In FIG. 1, reference is made to the receptacle, 10, with stem 50. Four fins 15 are shown, although as will be appreciated by those in the art, there may be more or less, so long as a stable structure can be formed. Each fin 15 has a preferred but optional holder tab 20 that together fit around the smoke detector housing as is depicted in FIG. 3. Each tab 20 may have an optional gripper pad 25 made of a material that facilitates a tight seal on the housing, materials including, but not limited to, rubbers, silicones, polymers, plastics, etc. In many embodiments, this is not required and may not be preferred. The fins come together to form an asymmetrical insertion tab 30 (sometimes referred to herein as the "insertion key" or "insertion hub") that fits into a smoke detector housing with a corresponding slot in the same shape (the "insertion slot" or "keyhole" 110 of FIGS. 2 and 3). It should be noted that the insertion tab 30 is preferably of an asymmetrical shape, whether a T shape, a triangle, a rectangle, or other polygons, etc. The asymmetrical shape allows the device to only fit together with a smoke detector housing with the corresponding asymmetrical insertion slot 110 in one way, so as to facilitate torsional rotation to unscrew the housing from its mounting plate using the traditional screw lines or mounting locks found in smoke detection mounting plates.

Similarly, in a preferred embodiment, the device may optionally contain an additional locking tab 40 that fits into a corresponding locking slot 115 in the smoke detector housing. Again, while depicted as a rectangular tab, other geometries are allowed.

Figure 4:
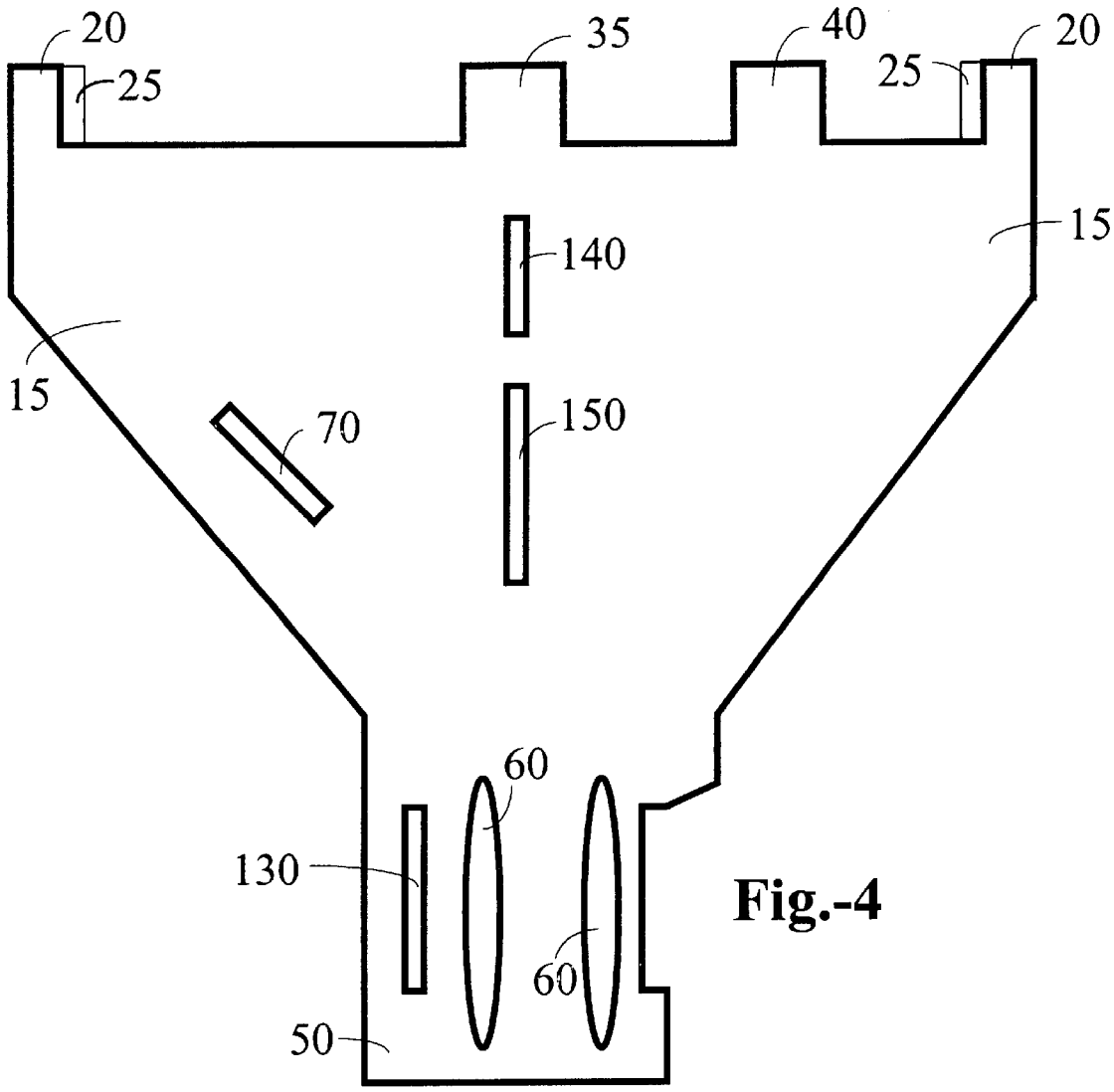
FIG. 4 depicts a preferred base piece.
Figure 5A:
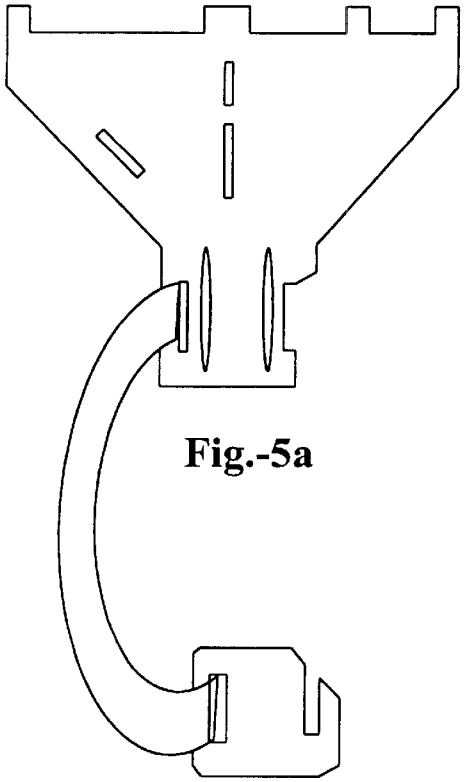
Figure 5B:
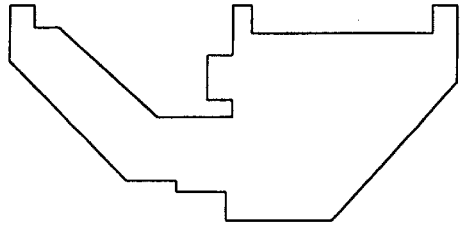
Figure 5C:
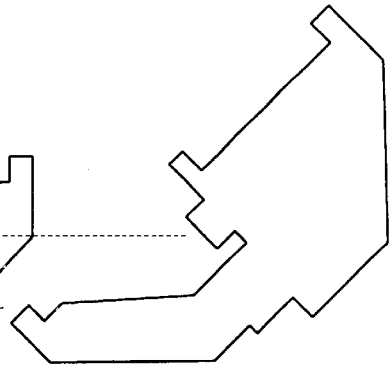
Figure 5D:
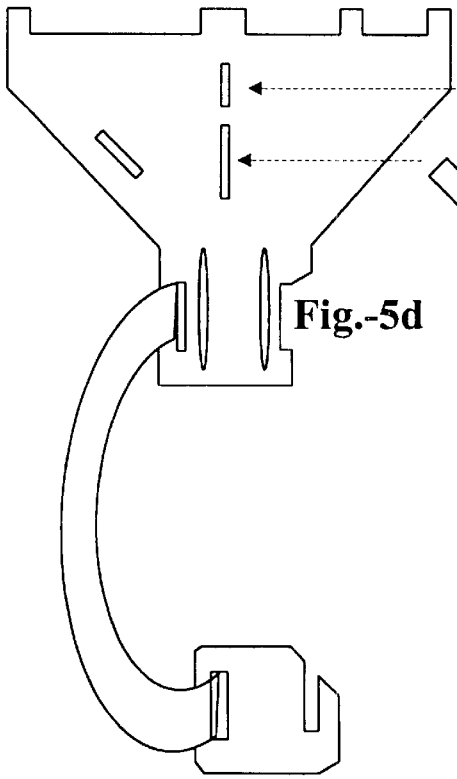
Figure 5E:
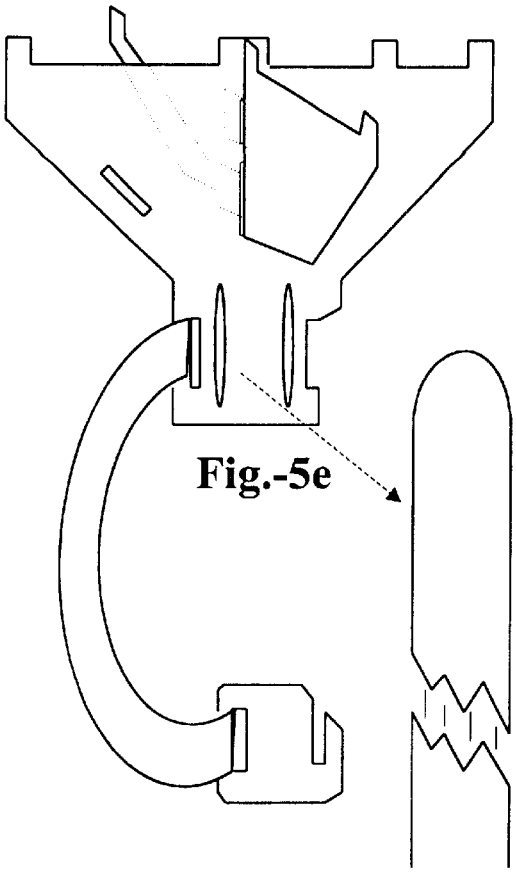
Figure 5F:
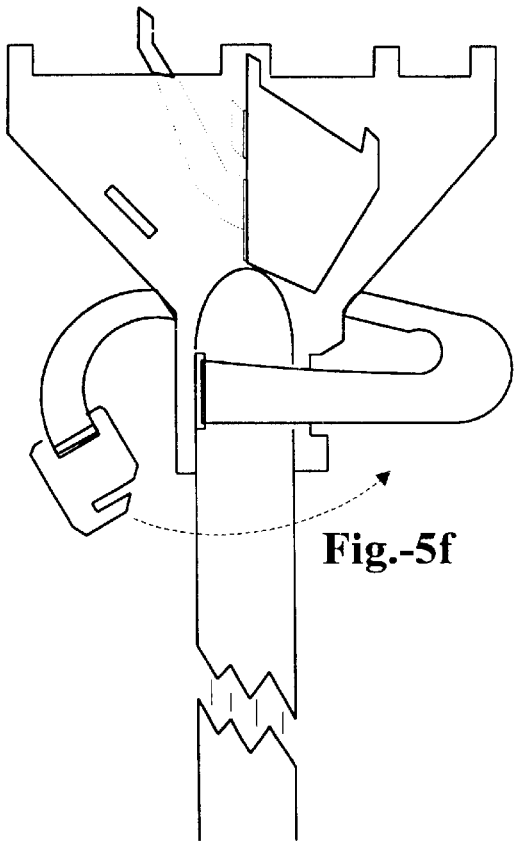

In addition, the device 10 comprises a stem 50. In a preferred embodiment, the device comprises an attachment component preferably connected to the stem 50, although other places for connection are allowed as well. The attachment component can be configured in a variety of ways. In a preferred embodiment, the attachment component comprises a strip 80 of a suitable material and a clipping mechanism 90. In one embodiment, for example as depicted in FIGS. 4 and 5, the strip is attached through the use of a slot 130 that is used to insert the strip and glue the end to either the stem 50 or to itself 130. Suitable adhesives are outlined below.

The strip may be made of a variety of materials as elastic and other stretchy materials, including, but not limited to, rubber, silicone, surgical tubing, strapping or strips. In a preferred embodiment, when a strip is elastic, it is generally long enough to wrap several times (three or four being preferred) around the pole and then attached to the device using a clipping or attachment mechanism. In a preferred embodiment, this is a clip 90 that inserts into a slot 70 in the device. Other attachment mechanisms include snaps, etc.

In another embodiment, the attachment component may be a strip of self adhesive material such as velcro. In this embodiment, as is well known in the art, the strip comprises a first surface of "hooks" and a second surface of "loops", configured to allow attachment.

In addition, as outlined below, the attachment mechanism may comprise a cylinder into which the pole is inserted.

In a preferred embodiment, the stem may also optionally comprise a "seat" for the pole. In a preferred embodiment, the stem is substantially planar and this "seat" comprises two or more three dimensional strips 60 of flexible gripping material, such as rubber, silicone, glue, or other polymers. The pole seats itself between these strips. Alternatively, the stem may be curved, such as to form a half cylindrical shape, into which the pole goes. In this embodiment there may be strips of flexible gripping material as well, although they need not be raised into a three dimensional form. Similarly, in some embodiments, particularly when the device is cast of a single material, the stem may comprise a cylinder into which a pole may be inserted. There may be optional flexible gripping material on the inside of the cylindrical stem.

In a preferred embodiment, the device comprises two pieces that are assembled by the user (a "two component system"). This embodiment is preferred when the device is to be sold as a kit with the smoke detector unit, or when minimal storage space is at issue. In this embodiment, the device comprises a base piece and crosspiece, both of which are substantially planar (although they need not be, if desired), and are configured to be no larger than the box of the smoke detector. As outlined herein, there are two main embodiments of this configuration.

In a preferred embodiment, there are two components that form the device of the invention. This finds particular use in situations where the smoke detector unit is especially configured for the use of the device, that is, when it contains at least one slot (such as 110 or 115 of FIG. 2) into which a tab of the device can be inserted. It should be noted that in some instances, even when the smoke detector unit is not especially configured, the end user can drill or pierce the smoke detector unit housing to create slots 110 and/or 115.

Figure 6:
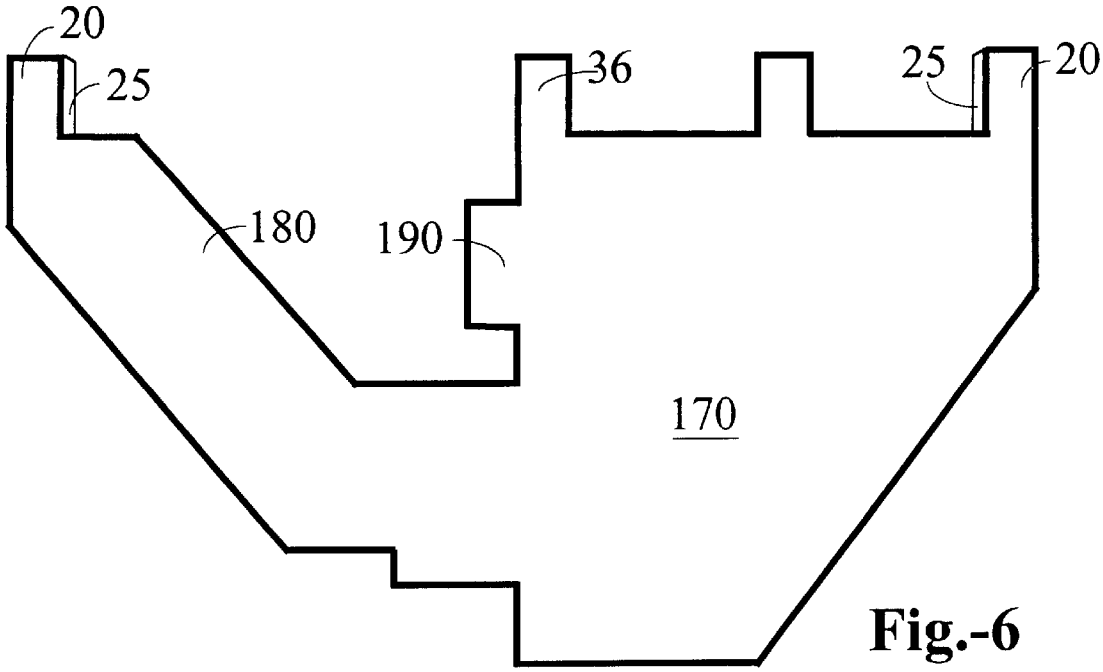
FIG. 6 depicts a crosspiece.

In this embodiment, depicted in FIGS. 4 and 6, the device comprises two components: a base piece and a crosspiece, both of which are substantially planar. The base piece 160 comprises two fins 15, a preferred but optional holder tab 20 that together fit around the smoke detector housing as is depicted in FIG. 3 for the one component "receptacle" device. Again, each tab 20 may have an optional gripper pad 25 made of a material that facilitates a tight seal on the housing. The base piece 160 has an insertion component 35 that will come together with the crosspiece insertion component 36 to form the insertion tab 30; again, this is depicted as a "T shape", although other asymmetrical shapes (plain rectangles, etc.) can also be used. Base piece 160 also has optional slot 70 for the insertion of attachment component clip 90. In addition, base piece 160 has at least one, and preferably two, assembly slots, 140 and 150, that are used for the insertion of the crosspiece 170.

As above for the one component device, the base piece 160 has a stem 50. Again, in a preferred embodiment, the device comprises an attachment component preferably connected to the stem 50, although other places for connection are allowed as well. The attachment component can be configured in a variety of ways. In a preferred embodiment, the attachment component comprises a strip 80 of a suitable material and a clipping mechanism 90. In one embodiment, for example as depicted in FIGS. 4 and 5, the strip is attached through the use of a slot 130 that is used to insert the strip and glue the end to either the stem 50 or to itself 130. Suitable adhesives are well known in the art and will depend on the materials to be attached, and include chemicals, glue and other bonding agents.

Also as above for the one component device, the stem 50 of the base piece 160 can be configured in a variety of ways (e.g. non-planar half- or full cylinders, with or without gripping material 60 to provide a "seat" for the pole 120.

The crosspiece 170 again has two fins 15, a preferred but optional holder tab 20 that together fit around the smoke detector housing as is depicted in FIG. 3 for the one component "receptacle" device and in FIG. 5 for the two component system. Again, each tab 20 may have an optional gripper pad 25 made of a material that facilitates a tight seal on the housing. The crosspiece 170 has an insertion component 36 that will come together with the base piece insertion component 35 to form the insertion tab 30. Crosspiece 170 further comprises at least one, and preferably two, tabs, 180 and 190, configured to insert into the assembly slots 140 and 150 of the base piece. With certain materials, the use of two tabs, 180 and 190, allows a higher level of stability of the final "receptacle" than the use of just one; however, in some cases, only a single tab may be used.

The fins 15 of the base piece 160 and the crosspiece 170 come together to form a four pronged "receptacle". Again, it is possible to have either more or fewer fins, depending on the system. As will be appreciated by those in the art, the size of the device will depend on the size of the smoke detector unit. For example, in some cases, when the smoke detector housing is round and roughly 4.75 inches in diameter, the base piece has roughly a 5.5 inch length and width to account for the holder tab 20 length on each side, and the crosspiece is similar.

The insertion tab 30 in the two component system is made up of insertion components 35 and 36. an attachment component attached to either the base piece or the crosspiece for the attachment of the device to a pole. Again, as outlined herein, this pole may be a broom, cane, rake, etc., a longer commercial pole or a retractable, collapsible pole.

For the devices outlined above, the smoke detector unit requires at least one slot (depicted in FIGS. 2 and 3 as 110 and 115) for insertion of an insertion tab 30 or 40 (or both) in order to allow the placement of the device and removal/replacement of the smoke detector unit on its mounting plate.

Figure 7:
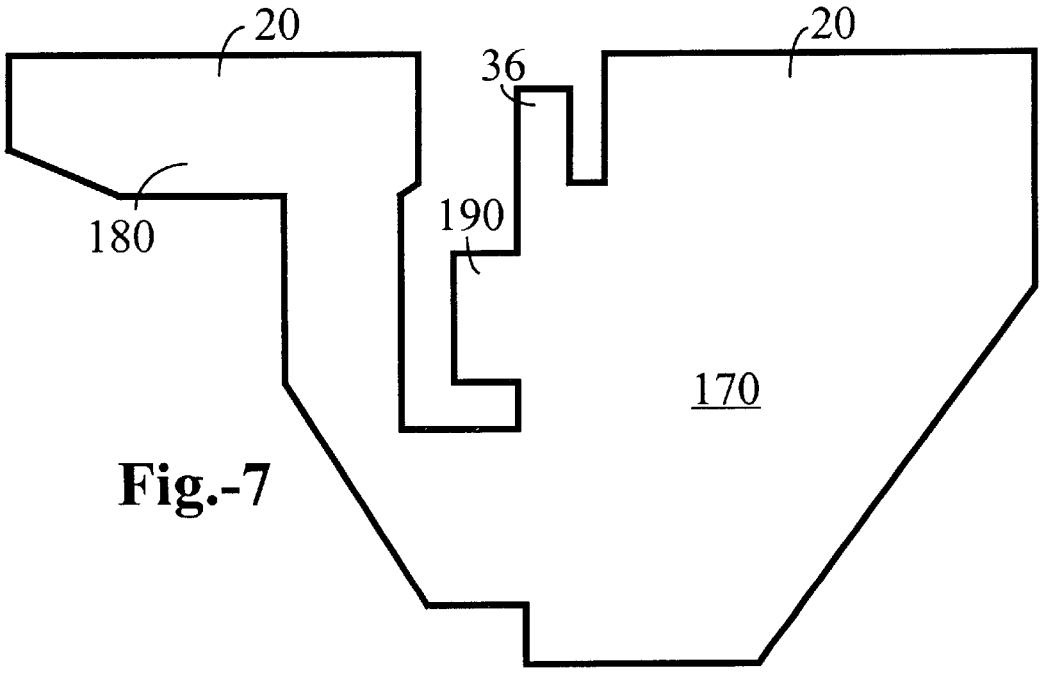
FIG. 7 depicts an additional crosspiece, for use with an external mount adapter.

In an additional preferred embodiment, the invention provides the means to allow current smoke detector devices to be adapted for use with the device. In this embodiment, the device may be configured slightly differently. In this embodiment, as depicted in FIG. 7, an exterior mount bracket 200 is used. The bracket 200 comprises a piece of material in preferably an inverted "u" or concave shape, such that the insertion tab 30 can fit into the insertion slot 110 of the bracket 200 and provide sufficient attachment to allow the use of the device. Alternatively, depending on the depth of the insertion tab 30 and/or the configuration of the smoke detector housing, the bracket may be a straight or planar shape. For example, if the bracket 200 is deep enough, a planar bracket may be used. The bracket 200 comprises at least one, and preferably two, ends 115 that lie flush with the housing 100. In a preferred embodiment, the ends 115 comprise an optional adhesive component 230, such as velcro tape, that is used to attach the bracket 200 to the housing 100. In the case of velcro, one half of the velcro tape is applied to the housing 100 (not shown), and the other half to the bottom of the ends 115. As will be appreciated by those in the art, the attachment of the bracket 200 to the housing 100 can be done in a variety of ways, including glues, velcro, and other adhesives.

Figure 8:
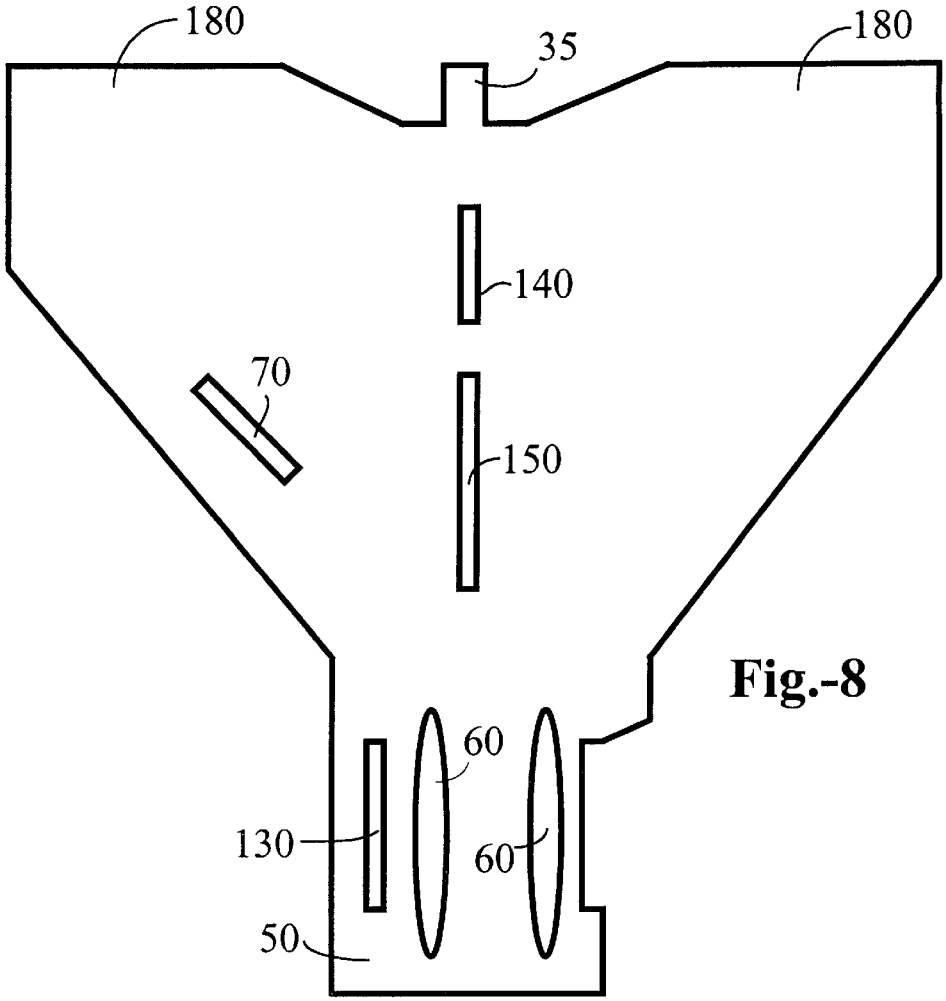
FIG. 8 depicts a base piece for use with an external mount adapter.
Figure 9:
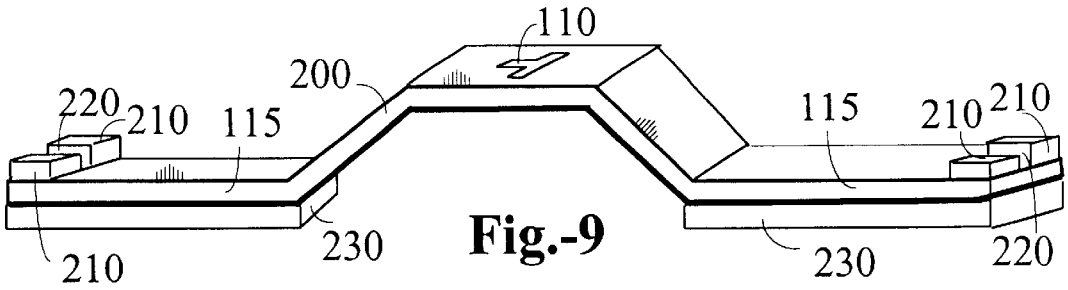
FIG. 9 depicts an external mount adapter.

The bracket 200 further comprises a groove 220 at each end 115 for insertion of the holder tabs 20 of either of the base piece or the crosspiece. That is, in this embodiment, only a single set of holder tabs 20 are required. It should also be noted that while FIG. 9 depicts the groove 220 as being formed from two protrusion tabs 210 on each end 115, other embodiments utilize a groove "dug" or machined into the end 115 (not shown). FIGS. 7 and 8 depict a base piece 160 with assembly slots 140 and 150 (again, only one may be used), optional slot 70 for the insertion of attachment component clip 90, insertion tab 35 and stabilization tabs 180, which may rest on the housing 110. The crosspiece 170 has an insertion component 36 that will come together with the base piece insertion component 35 to form the insertion tab 30. Crosspiece 170 further comprises at least one, and preferably two, tabs, 180 and 190, configured to insert into the assembly slots 140 and 150 of the base piece. As will be appreciated by those in the art, if the exterior mount 200 is curved, holder tabs 180 and 190 can be correspondingly curved as well. As outlined herein, with certain materials, the use of two tabs, 180 and 190, allows a higher level of stability of the final "receptacle" than the use of just one; however, in some cases, only a single tab may be used. In addition, holder tabs 20 are configured to fit into groove 220 of the external mount bracket 200; in this embodiment, the holder tabs 20 are longer to allow stability in the groove 220.

Figure 10:
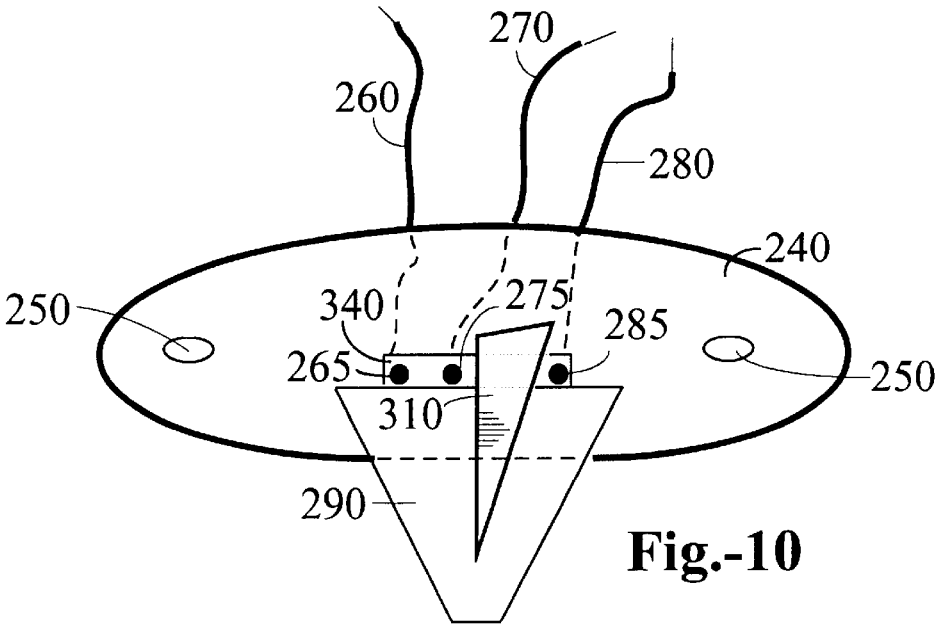
FIG. 10 depicts a mounting plate for use with AC systems.
Figure 11:
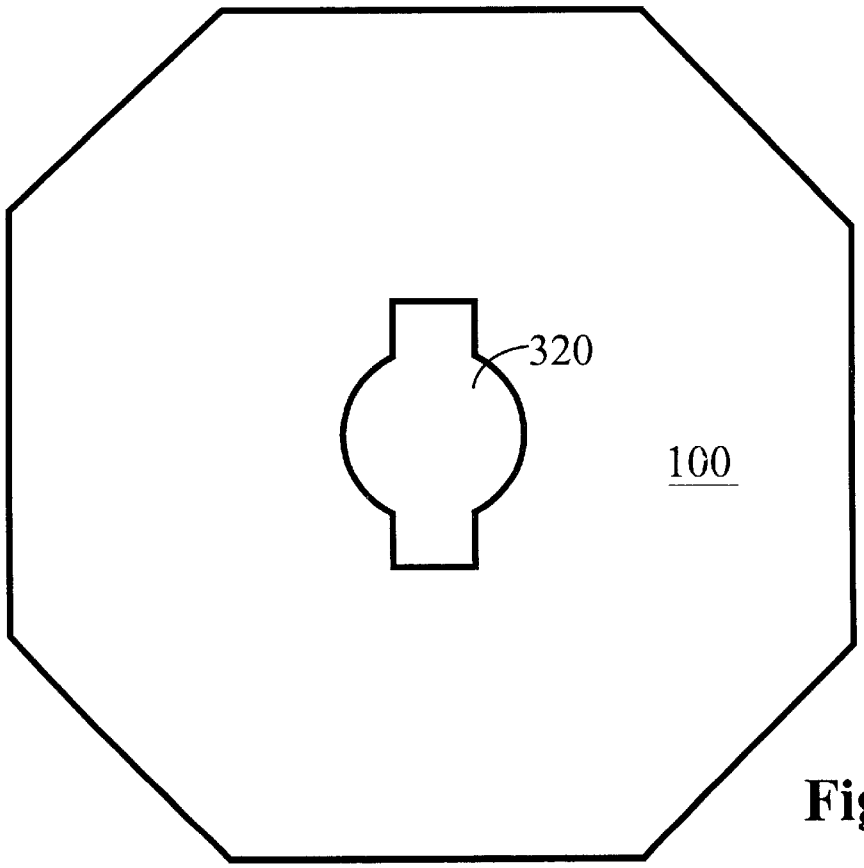
FIG. 11 depicts the top plate of a smoke detector housing.

In an alternate preferred embodiment, the device is especially configured to be used with hard wired or AC units, that comprise both electronic components and battery backup. This is generally depicted in FIGS. 10 and 11. In this embodiment, the mounting plate 240 is configured to fit a standard recessed or surface mounted outlet box that conforms to widely accepted building codes. The mounting plate 240 contains screw holes 250 for attachment to an outlet box, the wall, or ceiling. Hot wire 260, ground wire 270 and neutral wire 280 emerge from the wall or ceiling and lead, through the mounting bracket stem 340 to interconnects or contacts 265, 275 and 285, respectively, within to mounting bracket 290 with at least several fins 310. The smoke detector housing 100, depicted in FIG. 11, comprises a "keyhole" orifice 320 in the top that receives the mounting bracket 290 and results in the attachment of the housing 100 to the mounting plate. The fins 310 extend past the boundary of the center of the bracket 290, such that the fins will rest and contain the keyhole orifice 320. The outer plate or housing of the invention comprises a surface with the insertion slot 110 and/or 115.

Figures 12, 12A, 12B, 12C, 12D, 12E:
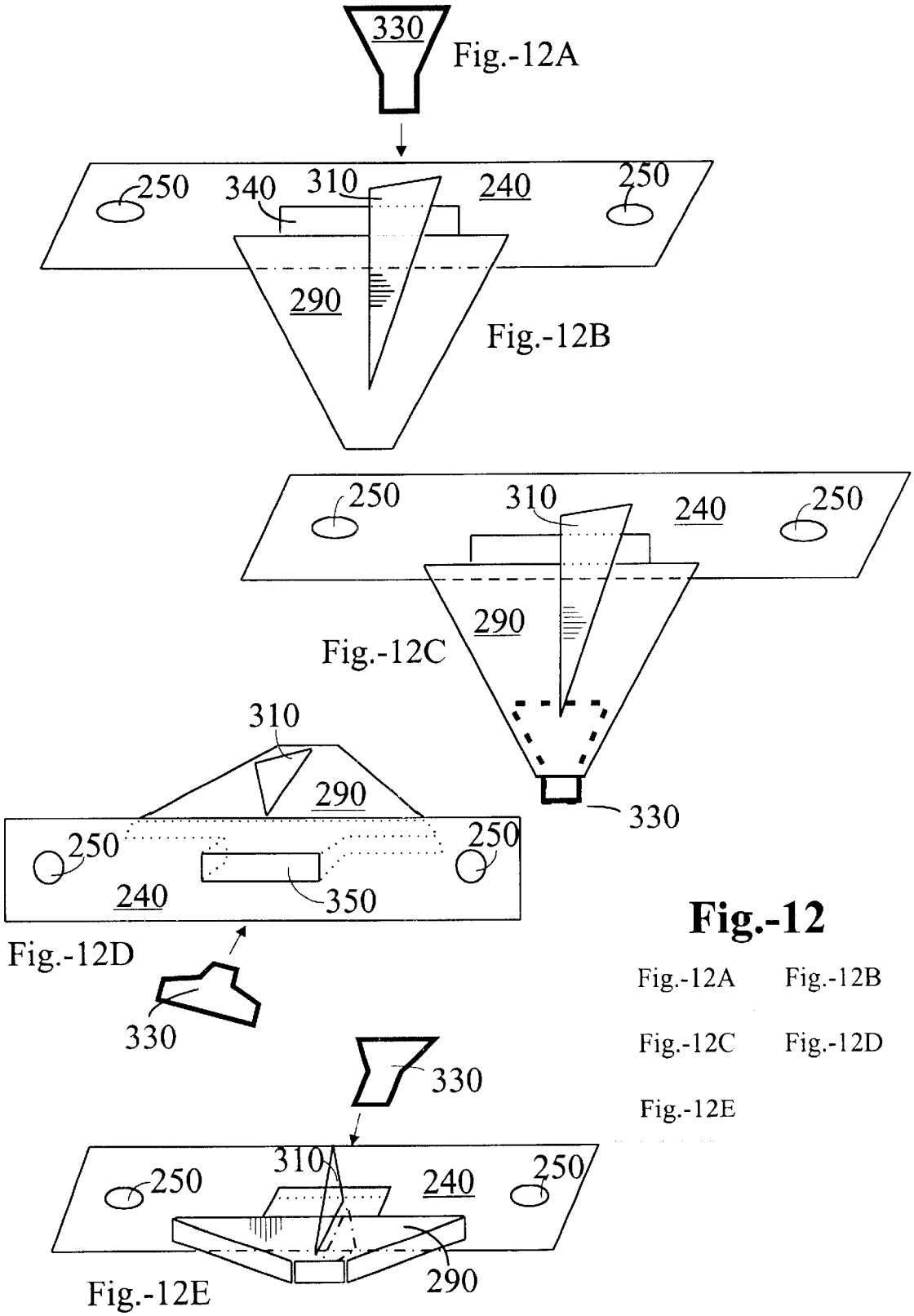
FIGS. 12A–E and 13 depict the anti-tamper embodiments.
Figure 13:
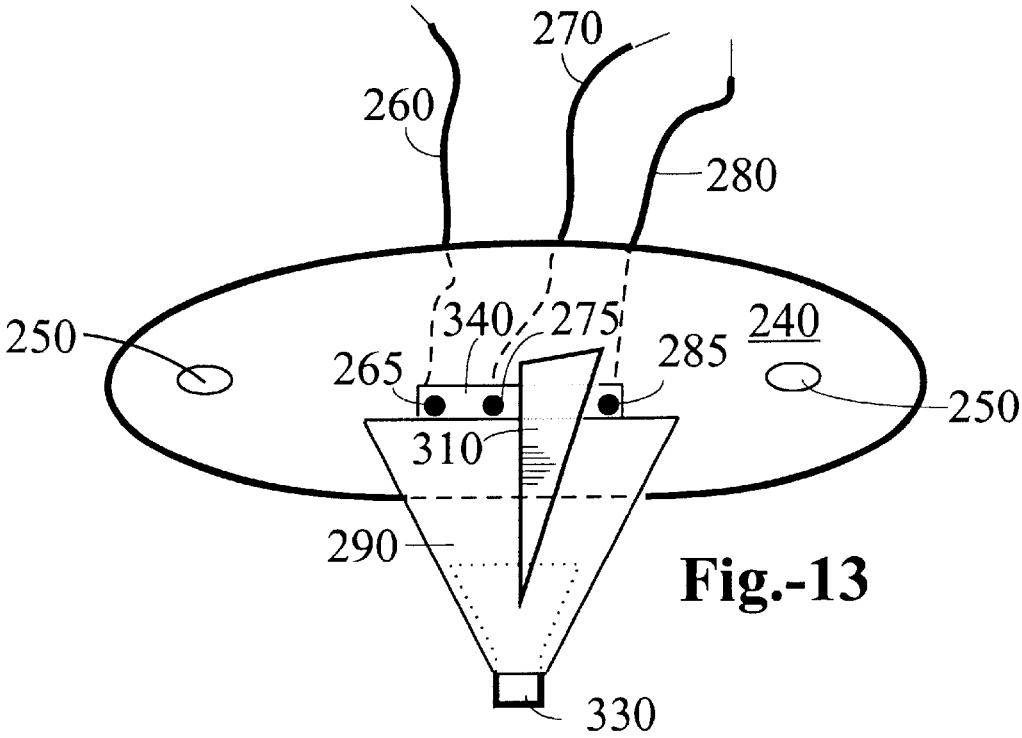

In addition, this general embodiment can be used with non-wired systems as well. In addition, as depicted in FIGS. 12 and 13, the mounting plate 240 and keyhole housing 330 embodiment may be used with a locking or anti-tamper system. In this system, there is a gravity activated anti-tamper tab 320 which is placed, via a slot 350 in the mounting plate, within the mounting bracket 290. The tab 320, when inserted, falls down and extends past the end of the mounting bracket 290, such that the smoke detector unit 100 cannot be removed unless it is retracted using the device of the invention. That is, only when the insertion tab 30 is in place will the anti-tamper tab be retracted and the unit 100 allowed to be removed.

As will be appreciated by those in the art, the components of the invention, and in particular the base piece and crosspiece (or the receptacle in the one component system), can be made from a wide variety of materials. Preferred materials include, but are not limited to, fiberglass, teflon, ceramics, glass, silicon, mica, any number of different polymers including plastic (including acrylics, polystyrene and copolymers of styrene and other materials, polypropylene, polyethylene, polybutylene, polycarbonate, polyurethanes, KEVLAR™, Teflon™, and derivatives thereof, etc.), as well as derivatives.

In some embodiments, one or more the components of the device may be marked ("slot A", "tab B"), etc.

In addition, the present invention provides kits comprising a smoke detector and the device of the invention. This generally includes instructions, such as are depicted in FIG. 5.

All references cited herein are incorporated by reference.

I claim:

1. A smoke detector changing device comprising:

a) a first substantially planar base piece comprising an assembly slot;

b) a second substantially planar crosspiece, comprising an assembly tab for insertion into said assembly slot;

wherein either the base piece or the crosspiece or the combination of said base piece and said crosspiece forms an asymmetrical insertion tab configured to fit into an asymmetrical slot in a smoke detector housing; and c) an attachment component attached to either the base piece or the crosspiece for the attachment of the device to a pole.

2. A kit comprising the smoke detector changing device of claim 1 and the smoke detector including a smoke detector housing having an asymmetrical slot adapted to receive said asymmetrical insertion tab.

3. A device according to claim 1 wherein, when assembled, said base piece and said crosspiece form a three dimensional receptacle configured to receive the smoke detector housing, said device comprising holder tabs to engage the smoke detector housing.

4. A device according to claim 3 wherein said base piece and said crosspiece each have holder tabs located at the outer ends thereof and, when said base piece and said crosspiece are assembled, said receptacle is defined by said holder tabs.

5. A kit comprising the smoke detector changing device of claim 3 and a smoke detector including a smoke detector housing having an asymmetrical slot adapted to receive said asymmetrical insertion tab.

6. A smoke detector changing device comprising:

a) a base piece comprising an assembly slot;

b) a crosspiece comprising an assembly tab for insertion into said assembly slot;

c) an exterior mounting adapter bracket for attachment to a smoke detector, said bracket comprising an asymmetrical slot and adhesive mounts;

wherein either the base piece or to crosspiece or the combination of said base piece and said crosspiece forms an asymmetrical insertion tab configured to fit into said asymmetrical slot; and d) an attachment component attached to either to base piece or the crosspiece for the attachment of the device to a pole.

7. A device according to claim 6 wherein said base piece and said crosspiece are substantially planar.

8. A kit comprising the smoke detector changing device of claim 6 and a smoke detector including a smoke detector housing having an asymmetrical slot adapted to receive said asymmetrical insertion tab.

9. A device according to claim 1, 3 or 6 wherein said attachment component comprises a rubber strap and a holder.

10. A smoke detector changing device comprising:

a) a first base piece comprising an assembly slot;

b) a second crosspiece, comprising an assembly tab for insertion into said assembly slot;

wherein either the base piece or the crosspiece or the combination of said base piece and said crosspiece forms an asymmetrical insertion tab configured to fit into an asymmetrical slot in a smoke detector housing;

c) an attachment component attached to either the base piece or the crosspiece for the attachment of the device to a pole; and d) a rubber strap and a holder;

wherein said holder comprises a clip with at least one tab that fits into a slot in said device.

11. A device according to claim 10 wherein said second crosspiece is substantially planar.

12. A device according to claim 11 wherein said first base piece is substantially planar.

13. A device according to claim 10 wherein said attachment component comprises a flexible gripping material.

14. A smoke detector changing device comprising an engagement component comprising a receptacle configured to receive a smoke detector housing, said device comprising holder tabs to engage said housing and an attachment component for the attachment of said device to a pole, wherein said attachment component comprises a rubber strap and a holder, and wherein said holder comprises a clip with at least one tab that fits into a slot in said device.

15. A device according to claim 14 wherein said engagement component is substantially planar.

16. A device according to claim 14 wherein said receptacle is a three dimensional receptacle.

17. A device according to claim 14 wherein said holder tab is an asymmetrical insertion tab.

18. A device according to claim 14 wherein said attachment component comprises a flexible gripping material.

19. A smoke detector changing device comprising:

a) a base piece comprising an assembly slot;

b) a crosspiece comprising an assembly tab for insertion into said assembly slot;

c) an exterior mounting adapter bracket for attachment to a smoke detector, said bracket comprising an asymmetrical slot and adhesive mounts;

wherein either the base piece or the crosspiece or the combination of said base piece and said crosspiece forms an asymmetrical insertion tab configured to fit into said asymmetrical slot; and d) an attachment component attached to either the base piece or the crosspiece for the attachment of the device to a pole;

wherein said attachment component comprises a rubber strap and a holder, and wherein said holder comprises a clip with at least one tab that fits into a slot in said device.

20. A device according to claim 19 wherein said crosspiece is substantially planar.

21. A device according to claim 20 wherein said base piece is substantially planar.

22. A device according to claim 19 wherein said attachment component comprises a flexible gripping material.

* * * * *